US009980334B2

(12) United States Patent
Radermacher et al.

(10) Patent No.: US 9,980,334 B2
(45) Date of Patent: May 22, 2018

(54) LED LIGHTING SYSTEM

(71) Applicant: PHILIPS LIGHTING HOLDING B.V., Eindhoven (NL)

(72) Inventors: Harald Josef Günther Radermacher, Aachen (DE); Klaas Jacob Lulofs, Eindhoven (NL); Lino Adriaan Nicolaas Wilhelm De Wit, Eindhoven (NL); Peter Hubertus Franciscus Deurenberg, s-Hertogenbosch (NL)

(73) Assignee: PHILIPS LIGHTING HOLDINGS B.V., Eindhoven (NL)

( * ) Notice: Subject to any disclaimer, the term of this patent is extended or adjusted under 35 U.S.C. 154(b) by 0 days. days.

(21) Appl. No.: 14/394,763

(22) PCT Filed: Apr. 26, 2013

(86) PCT No.: PCT/IB2013/053298

§ 371 (c)(1),
(2) Date: Oct. 16, 2014

(87) PCT Pub. No.: WO2013/168042

PCT Pub. Date: Nov. 14, 2013

(65) Prior Publication Data

US 2015/0123549 A1 May 7, 2015

Related U.S. Application Data

(60) Provisional application No. 61/643,976, filed on May 8, 2012.

(30) Foreign Application Priority Data

May 8, 2012 (EP) ..... 12167070

(51) Int. Cl.
*H05B 33/08* (2006.01)

(52) U.S. Cl.
CPC ..... *H05B 33/0854* (2013.01); *H05B 33/083* (2013.01); *H05B 33/089* (2013.01); *H05B 33/0827* (2013.01); *H05B 33/0848* (2013.01)

(58) Field of Classification Search
CPC .. H05B 33/08; H05B 33/0827; H05B 33/083; H05B 33/0848; H05B 33/0854; H05B 33/089

(Continued)

(56) References Cited

U.S. PATENT DOCUMENTS

2008/0074061 A1 3/2008 Chen et al.
2009/0079359 A1* 3/2009 Shteynberg ..... H05B 33/0818 315/291

(Continued)

FOREIGN PATENT DOCUMENTS

JP 2007290698 A 11/2007
NL WO 2012052875 A2 * 4/2012 ..... H05B 33/0809
WO 2013064973 A1 5/2013

*Primary Examiner* — Douglas W Owens
*Assistant Examiner* — Henry Luong
(74) *Attorney, Agent, or Firm* — Akarsh P. Belagodu

(57) ABSTRACT

The invention relates to a LED lighting system comprising a power supply circuit and at least one LED module. The power supply circuit comprises input terminals (K1, K2) for connection to a supply voltage source and output terminals (K3, K4),and a driver circuit (I, II) coupled between the input terminals and the output terminals for generating a LED current out of a supply voltage supplied by the supply voltage source, and comprising a driver control circuit (II) with an input terminal (K7) for receiving a current control signal and for generating a LED current in dependency of the current control signal. The at least one LED module comprises input terminals (K5, K6) for coupling to the output terminals of the power supply circuit, a LED load (LS) coupled between the input terminals, and a module control circuit for generating a current control signal as a (Continued)

square wave shaped signal comprising a first part having a first amplitude during a first time lapse representing a desired magnitude of the LED current, said module control circuit comprising an AC coupling of the current control signal to the input terminal of the driver control circuit.

20 Claims, 6 Drawing Sheets

(58) Field of Classification Search
USPC ..... 315/185 R, 291, 297, 307–309, 360
See application file for complete search history.

(56) References Cited

U.S. PATENT DOCUMENTS

2012/0025735 A1* 2/2012 Wang ..... H02M 3/33507 315/294
2012/0299500 A1* 11/2012 Sadwick ..... H05B 33/0887 315/224

* cited by examiner

LED LIGHTING SYSTEM

CROSS-REFERENCE TO PRIOR APPLICATIONS

This application is the U.S. National Phase application under 35 U.S.C. § 371 of International Application No. PCT/IB13/053298, filed on Apr. 26, 2013, which claims the benefit of U.S. Provisional Patent Application No. 61/643,976, filed on May 8, 2012 and European Patent Application No. 12167070.7 filed on May 8, 2012. These applications are hereby incorporated by reference herein.

FIELD OF THE INVENTION

The invention relates to a LED lighting system comprising a power supply circuit and one or more LED modules. More in particular the invention relates to a LED lighting system, wherein the power supply circuit adjusts the power supplied to the LEDs in the LED modules in dependency of signals generated by circuitry comprised in the LED modules, said signals in turn depending on the nominal power of the LEDs comprised in the LED module.

BACKGROUND OF THE INVENTION

Lighting systems based on LEDs are used on an increasing scale.

LEDs have a high efficiency and a long life time. In many lighting systems, LEDs also offer a higher optical efficiency than other light sources. As a consequence LEDs offer an interesting alternative for well-known light sources such as fluorescent lamps, high intensity discharge lamps and incandescent lamps.

The lighting systems based on LEDs often comprise a power supply circuit that supplies power to the LEDs comprised in one or more LED modules that, at least during operation, are electrically connected to output terminals of the power supply circuit. Typically the total current supplied by the power supply circuit depends on the number of LED modules connected to the power supply circuit and more in particular on the desired current that is required by and suitable for each of the LED modules and possibly also on the temperature of the LED modules. Each LED module LM comprised in a LED lighting system called Fortimo manufactured by Philips, which is presently on the market and shown in FIG. 1, comprises a first resistor Rset having a resistance that represents the desired current suitable for the LEDs comprised in the LED module. Each LED module LM also comprises a second resistor NTC with a temperature dependent resistance. When one of these LED modules LM is connected to the power supply circuit PSC, a circuit MC, which is comprised in the power supply circuit PSC, causes a current to flow through the first resistor Rset and another current to flow through the second resistor NTC. The voltages across each of the resistors are measured and the value of the resistance of each of the resistors is determined by the circuit MC from the measured voltage across each of the resistors. From these data, the circuit part MC derives a value for the LED current. A driver circuit DC, which is comprised in the power supply circuit PSC, subsequently adjusts the current supplied to the LED modules to the derived value.

An important disadvantage of this prior art system and method is that three wires are required for connecting the resistors in the LED module with circuitry comprised in the power supply circuit. This makes these existing LED lighting systems rather complex. Furthermore, in case the LED lighting system comprises more than one LED module, this prior art does not allow more than one LED module to be arranged in series or in parallel according to the preference of a user.

SUMMARY OF THE INVENTION

The invention aims to provide a less complex LED lighting system, that is easier to manufacture and also easier to install and that allows both series and parallel arrangement of the LED modules to a single power supply circuit.

According to a first aspect of the invention a LED lighting system is provided, comprising a power supply circuit and at least one LED module. The power supply circuit comprises input terminals for connection to a power supply source and output terminals, and a driver circuit coupled between the input terminals and the output terminals for generating a LED current, the driver circuit comprising a driver control circuit with an input for receiving a current control signal and for generating a LED current in dependency of the current control signal. The at least one LED module comprises input terminals for coupling to the output terminals of the power supply circuit, a LED load coupled between the input terminals, and a module control circuit for generating the current control signal as a signal comprising a first part having a first amplitude during a first time lapse, the duration of the first time lapse representing a desired magnitude of the LED current, said module control circuit comprising an AC coupling of the current control signal to the input terminal of the driver control circuit. The AC coupling can, for example, be implemented via a coupling terminal.

The current control signal is preferably square wave shaped. Only one wire is needed for communication between the LED module and the power supply circuit to communicate the current control signal. As a consequence, the LED lighting system according to the invention is comparatively simple and easy to manufacture and install. Furthermore, in case the LED lighting system comprises more than one LED module, the communication of the current control signal via AC coupling is compatible with both a parallel and a series arrangement of the LED modules between the output terminals of the power supply circuit, so that the possibilities and the degrees of freedom of the LED lighting system are increased.

According to a second aspect a method is provided for operating at least one LED module comprising a LED load by means of a driver circuit comprised in a power supply circuit, comprising the following steps:

- generating a current control signal as a signal comprising a first part having a first amplitude during a first time lapse, the duration of the first time lapse representing a desired magnitude of the LED current,
- communicating the current control signal to an input terminal of a driver control circuit via an AC coupling,
- generating a LED current using the driver control circuit based on the current control signal and supplying the LED current to the LED load.

This method offers the same advantages as a LED lighting system according to the invention.

In a first preferred embodiment of a LED lighting system according to the invention, the current control signal is temperature dependent. A current control signal that is temperature dependent allows a determination of the temperature of the LED module, or more particularly the temperature of the LEDs, and makes it possible to adjust the current generated by the driver circuit thereby controlling the temperature of the LEDs.

In a further preferred embodiment of a LED lighting system according to the invention, the temperature dependency of the current control signal is realized in such a way that the current control signal comprises a second part that has a second amplitude during a second time lapse, the duration of the second time lapse representing the temperature of the LEDs in the LED module. This particular temperature dependency allows a comparatively easy determination of the temperature.

In a still further preferred embodiment, the current control signal is a periodical signal, wherein each period comprises the first part of the current control signal or the first part and the second part of the current control signal. In case the still further preferred embodiment comprises at least two LED modules, it is preferably equipped with circuitry for generating a combined signal by superimposing the periodical current control signals generated by the LED modules and for supplying the combined signal to the input terminal of the driver control circuit.

It is noted that the circuitry for generating a combined signal may simply be a conductive connection between the coupling terminals of the LED modules.

In case such a combined signal is communicated to the driver control circuit it is advantageous that the driver control circuit is equipped with circuitry for deriving the periodical control signals generated by each of the LED modules from the combined signal.

In case all the periodical signals are derived from the combined signal, the temperature of each LED module is known. Thus also the value of the temperature of the LED module with the highest temperature is known. In case this highest temperature is too high it is possible to decrease the total LED current until the highest temperature is acceptable.

Also all the desired current magnitude for each of the LED modules is known. In case, for example, one of the desired current magnitudes differs substantially from the other current magnitudes it can be concluded that one of the LED modules needs to be exchanged.

A signal indicating that one of the LED modules needs to be exchanged can then be supplied to, for example, a building control system of which the LED lighting system is part of.

In another preferred embodiment according to the invention, the module control circuit comprises a first resistor with a resistance representing the desired magnitude of the LED current, and the module control circuit comprises a timer circuit coupled to the first resistor for generating the first part of the current control signal, and wherein the duration of the first time lapse is a function of the resistance of the first resistor. Preferably, the module control circuit comprises a second resistor with a temperature dependent resistance, wherein the second resistor is coupled to the timer circuit and the timer circuit is suitable for generating the second part of the current control signal, and wherein the duration of the second time lapse is a function of the resistance of the second resistor. The use of resistors to encode information regarding the desired LED current magnitude and temperature is cheap and efficient.

In still another preferred embodiment of a LED lighting system according to the invention, the driver circuit is equipped with circuitry for triggering the module control circuit of one or more of the LED modules connected to the power supply circuit to generate the first parts of the current control signals, and with circuitry for generating a combined signal by superimposing the AC coupled current control signals and for supplying the combined signal to the input terminal of the driver control circuit, wherein the driver control circuit is equipped with circuitry for deriving the desired magnitudes of the LED current of the LED modules from the combined signal.

In case the LED lighting system comprises more than one LED module, these LED modules are simultaneously triggered so that the first parts of the current control signals are synchronized. The result of this triggering is that a combined signal of all the first parts is generated and received by the input terminal of the driver control circuit. Since all the first parts are synchronized, they start at the same moment in time so that the duration of all the first time lapses can easily be derived from the combined signal.

Preferably, in case the current control signals comprise a first and a second part, the module control circuit is equipped with circuitry for generating the second part of the current control signal immediately after the first part, and the driver control circuit comprises circuitry for determining the temperature of the LEDs in the LED modules from the combined signal. In this case information regarding the temperature of the LEDs is also present in the combined signal received at the input terminal of the driver control circuit.

In order to be able to determine the information regarding the temperatures of the LED modules even better, it is even more preferred that the LED lighting system comprises circuitry for activating the module control circuits of the LED modules to generate the second parts of the current control signals after a delay time that is longer than the longest possible first part of the current control signal and starts at the same time as the first parts of the current control signals, and wherein the driver control circuit comprises circuitry for deriving the temperatures of the LEDs in the LED modules from the second time lapses in the combined signal.

The circuitry for activating the module control circuits to generate the second parts of the current control signal can be circuitry comprised in the driver control circuit that generates a second trigger pulse after the delay time. Alternatively, the circuitry for activating the module control circuits to generate the second parts of the current control signals can be comprised in the module control circuits of the LED modules.

Since the module control circuits are simultaneously activated to generate the second parts of the current control signals, also these second parts are synchronized and, because of the delay time, completely separated from the first parts of the current control signals. Since the second parts are synchronized, the temperatures of the LED modules can be determined more easily and more precisely.

In case the LED modules are arranged in parallel, the driver control circuit preferably comprises circuitry for determining the total LED current supplied to the LED modules in dependency of the sum of the desired currents coded in the durations of the first time lapses of the first current control signals.

Similarly, in case the LED modules are arranged in series, the driver control circuit preferably comprises circuitry for determining the total LED current supplied to the LED modules in dependency of the smallest desired magnitude of the LED current represented by the duration of the first time lapse in the first current control signal.

Preferably, the driver control circuit comprises circuitry for decreasing the total LED current in case one or more of the second parts of the current control signals indicates that the temperature of at least one LED module is too high.

In yet another preferred embodiment of a LED lighting system according to the invention, the module control circuit comprises a temperature dependent impedance in series with the coupling terminal, and the driver control circuit comprises circuitry for adjusting the LED current in dependency of the amplitudes of the current control signals received as a combined signal at the input terminal of the driver control circuit. In this embodiment the temperature information is encoded in the amplitude of the first part of the current control signals.

In case the combined signal is obtained by triggering the module control circuits to generate the current control signals, the first parts of the current control signals of the LED modules are synchronized. The combined signal is communicated to the input terminal of the driver control circuit and, in case the temperature dependent impedance is a temperature dependent resistor of the type NTC, the amplitude of the first part of the current control signal of the LED module with the highest temperature will be higher than that of the other first parts, and the same is true for the amplitude of the contribution of this first part in the combined signal. In case this highest amplitude indicates that the temperature of the LEDs in the LED module generating that current control signal is too high, this can be used to effectuate a decrease of the LED current.

BRIEF DESCRIPTION OF THE DRAWINGS

Embodiments of the invention will be further described making use of a drawing.

In the drawing.

DESCRIPTION OF EMBODIMENTS

Figure 1:
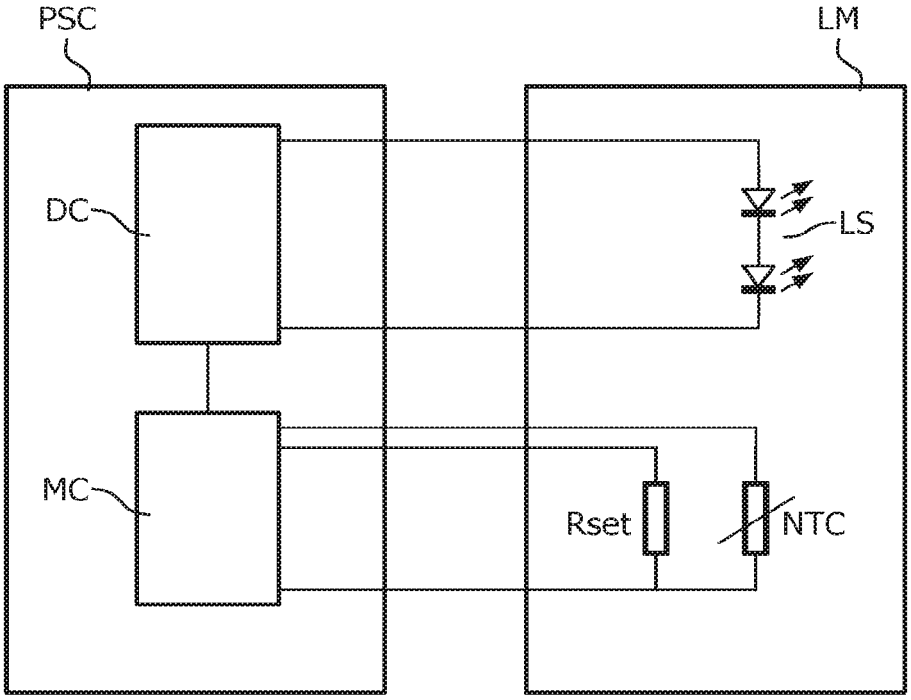
FIG. 1 (Prior Art)
FIG. 1 shows an embodiment of a prior art LED lighting system.
Figure 2:
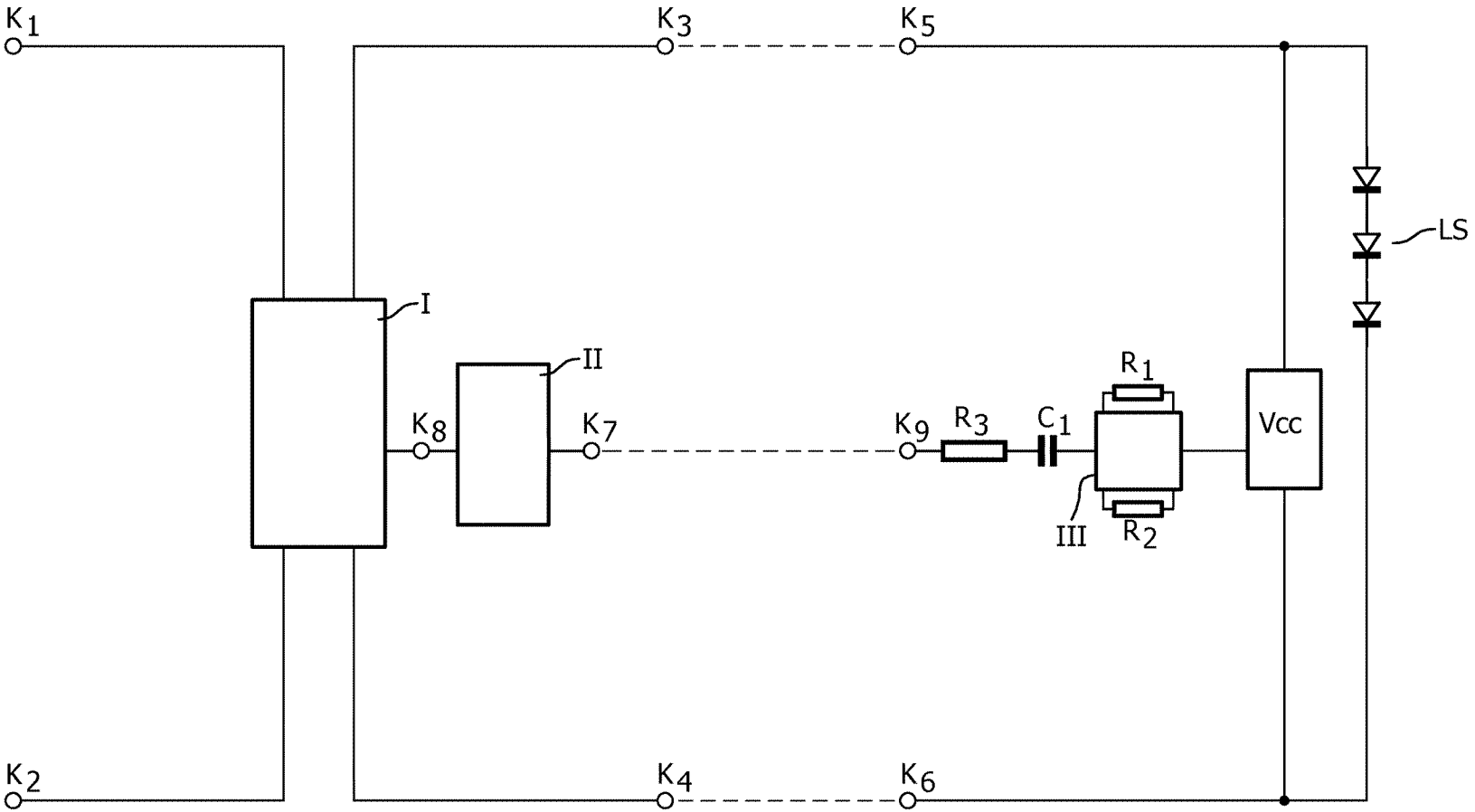
FIGS. 2-5 show respective embodiments of a LED light source according to the invention.

In FIG. 2, K1 and K2 are input terminals of a power supply circuit for connection to a supply voltage source. Input terminals K1 and K2 are connected to input terminals of circuit part I. First and second output terminals of circuit part I are connected to a first output terminal K3 and a second output terminal K4 of the power supply circuit respectively. Circuit part II is a driver control circuit. An output terminal K8 of circuit part II is coupled to an input terminal of circuit part I. Circuit part I and circuit part II together form a driver circuit for generating a LED current out of a supply voltage supplied by the supply voltage source. Circuit part II is equipped with an input terminal K7 for receiving a current control signal and for generating a LED current in dependency of the current control signal.

Terminals K5 and K6 are first and second input terminals of a LED module for connection to the first and second output terminals K3, K4 of the power supply circuit respectively. Input terminals K5 and K6 are connected by a LED load LS. Input terminals K5 and K6 are also connected to input terminals of a voltage supply circuit Vcc.

Circuit part III together with first, second and third resistors R1, R2, and R3, capacitor C1 and coupling terminal K9 forms a module control circuit for generating the current control signal. An output terminal of the voltage supply circuit Vcc is coupled to an input terminal of circuit part III. First resistor R1 is connected to input terminals of circuit part III and has a resistance representing a desired magnitude of the LED current. Second resistor R2 is connected to further input terminals of circuit part III and has a temperature dependent resistance. Circuit part III is a circuit part for generating a periodical substantially square wave shaped signal, wherein each period comprises a first part having a first amplitude during a first time lapse, wherein the duration, or length, of the first time lapse is a function of the resistance of first resistor R1, and a second part having a second amplitude during a second time lapse, wherein the duration of the second time lapse is a function of the resistance of temperature dependent second resistor R2. The duration of the first time lapse thus represents the desired magnitude of the LED current and the duration of the second time lapse represents the temperature of the LEDs in the LED module. An output terminal of circuit part III is connected to a first end of a series arrangement of a capacitor C1 and third resistor R3. A second end of the series arrangement is a coupling terminal K9 for AC coupling the current control signal to the input terminal K7 of the driver control circuit II.

It is noted that circuit part III may for example be implemented making use of one or several universal timer ICs, e.g. the NE555 or a low power multichannel version thereof.

Figure 6:
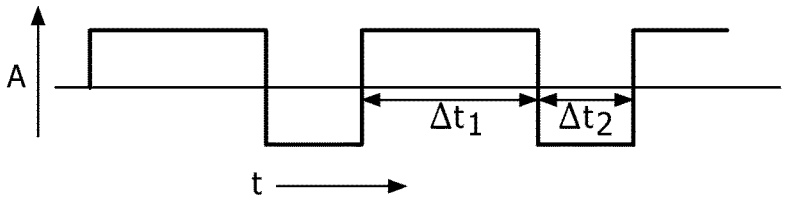
FIG. 6 shows a current control signal generated by the LED light source shown in FIG. 2 as a function of time.

The shape of the current control signal is shown in FIG. 6. The first amplitude of the periodical square wave shaped signal is a positive voltage and the second amplitude is a negative voltage. In FIG. 6, the absolute values of the first and second amplitude are chosen substantially equal. However, it is noted that this is not necessary. $\Delta t1$ and $\Delta t2$ are the durations of the first and the second time lapse respectively.

The operation of the LED light source shown in FIG. 2 is as follows. During operation the input terminals of the LED module are coupled to the output terminals of the power supply circuit and coupling terminal K9 of the LED module is coupled to input terminal K7 of the driver control circuit of the power supply circuit. In case input terminals K1 and K2 are connected to a voltage supply source, the driver circuit generates a LED current that flows through the LED load LS. The module control circuit generates the current control signal as a periodical square wave shaped signal, wherein each period comprises a first part having a first amplitude during a first time lapse that represents the desired magnitude of the LED current and a second part having a second amplitude during a second time lapse that represents the temperature of the LEDs in the LED module. In case the LED light source comprises only one LED module, the current control signal generated by this LED light module is communicated to input terminal K7 of the driver control circuit. The driver control circuit measures the first time lapse and second time lapse, and based on the measurement results determines the desired LED current and the temperature of the LEDs. For this purpose, the driver control circuit may for example comprise a microprocessor and a table in which values of the durations of the first and the second time lapse are related to values of the desired LED current and the temperature respectively. In case the temperature is not too high, i.e. not above a specific maximum value, the power supply circuit can subsequently supply a DC current equal to the desired current. Otherwise, i.e. in case the temperature is too high and above a specific maximum value, the DC current supplied to the LEDs may for example be decreased until the temperature of the LEDs is at or below a desired maximum value and thus no longer too high.

In case the LED light source comprises more than one LED module, the current control signals generated by the different LED modules are AC coupled to input terminal K7 of the driver control circuit II and are superimposed to form a combined signal. The combined signal is supplied to the input terminal K7 of the driver control circuit II.

It is noted that the AC coupling of the current control signal will generally cause a duty cycle dependent amplitude shift. Furthermore, since each of a plurality of LED modules is generating a current control signal at the same time and coupling this current control signal to the input terminal of the driver control circuit, the amplitude of each of the current control signals will generally be decreased due to the output impedances of the module control circuits of the LED modules. Depending on the magnitude of these impedances and the number of LED modules this decrease can be very large, for example approximately a factor ten in case ten LED modules are connected to the power supply circuit. As a consequence the combined signal present at the input terminal of the driver control circuit is a superposition of all these strongly attenuated signals.

The driver control circuit is equipped with circuitry for deriving the periodical current control signals generated by each of the LED modules from the combined signal. Subsequently the desired LED currents can be derived from the first time lapse of the first part of each of the current control signals. In case the LED modules are arranged in parallel, the LED driver circuit can for example generate a current that is equal to the sum of the desired currents derived from the first parts of each of the current control signals of the LED modules. In case the LED modules are arranged in series, the LED current generated by the driver circuit can be made equal to the lowest of the desired currents represented by the first time lapses. In both cases the total LED current generated by the driver can be decreased in case one or more of the second time lapses of the second parts of the current control signals indicate(s) that the temperature of one of the LED loads is too high.

Figure 3:
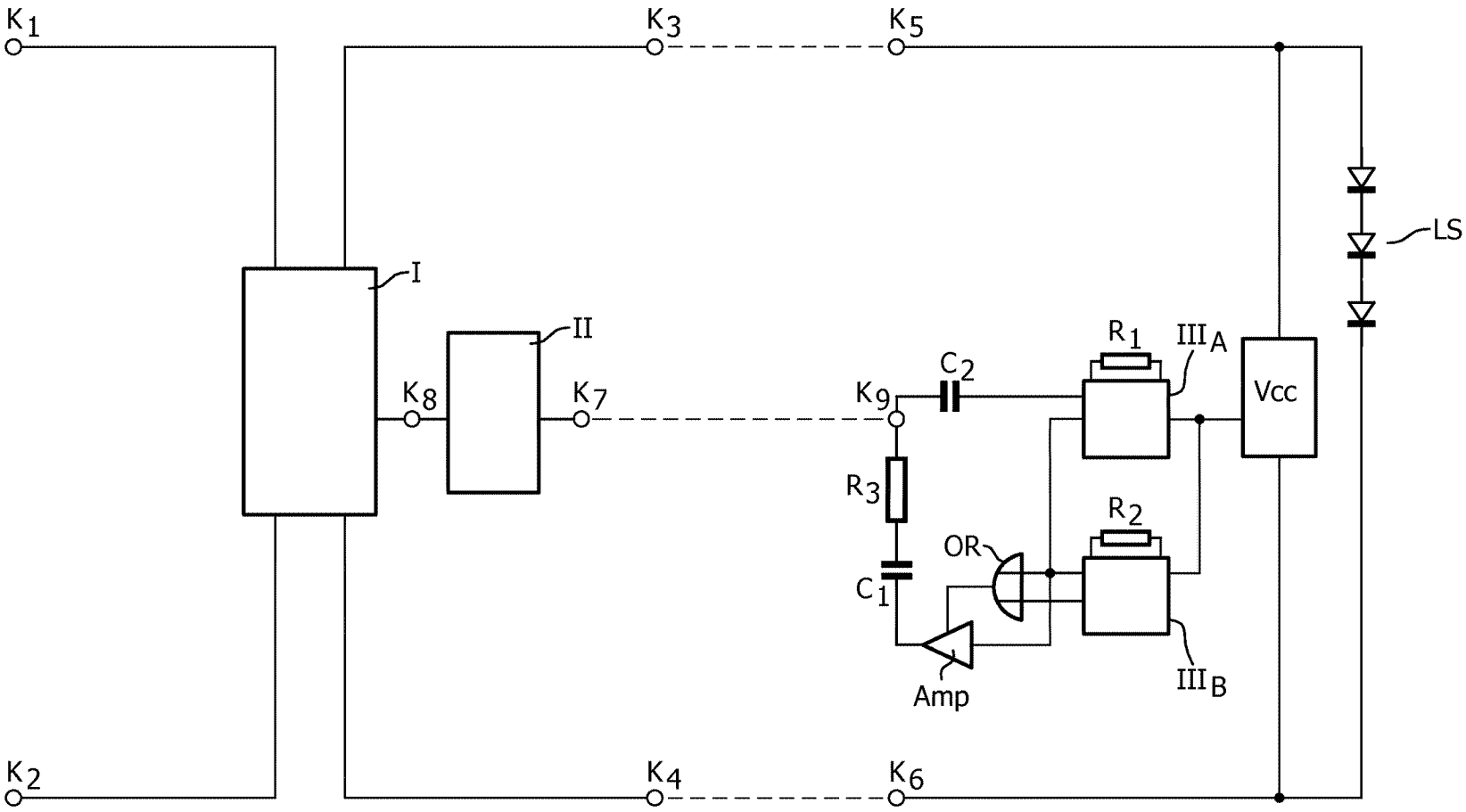

In FIG. 3 another embodiment of a LED lighting system according to the invention is shown. Components and circuit parts that are similar to those in the first embodiment shown in FIG. 2 are labeled with the same reference signs. In the LED module shown in FIG. 3, circuit parts IIIA and IIIB together with resistors R1, R2 and R3, capacitors C1 and C2, or-gate OR, buffer AMP and coupling terminal K9 together form a module control circuit. First resistor R1 is connected to first and second input terminals of circuit part IIIA. Second resistor R2 is connected to first and second input terminals of circuit part IIIB. It is noted that a possible implementation of both circuit part IIIA and circuit part IIIB is based on universal timer IC's, such as for example NE555. An output terminal of supply voltage source Vcc is connected to a third input terminal of circuit part IIIA and to a third input terminal of circuit part IIIB. A first output terminal of circuit part IIIA is connected to a first input terminal of or-gate OR, to a fourth input terminal of circuit part IIIB and to an input terminal of buffer AMP.

An output terminal of buffer AMP is connected to a first end of a series arrangement of a capacitor C1 and third resistor R3. A second end of the series arrangement is connected to a coupling terminal K9 for AC coupling the current control signal to the input terminal K7 of the driver control circuit II and for receiving a trigger pulse from the driver control circuit II. Capacitor C2 connects coupling terminal K9 to a fourth input terminal of circuit part IIIA. A first output terminal of circuit part IIIB is connected to a second input terminal of or-gate OR.

The operation of the LED light source shown in FIG. 3 is as follows. During operation the input terminals of the LED module are coupled to the output terminals of the power supply circuit and coupling terminal K9 of the LED module is coupled to input terminal K7 of the power supply circuit. In case input terminals K1 and K2 are connected to a power supply source, the driver circuit generates a LED current that flows through the LED load LS. The driver control circuit generates a trigger pulse TP that is communicated to the fourth input terminal of circuit part IIIA via terminals K7 and K9. Both terminals K7 and K9 thus function not only as an input or output terminal but as combined input/output terminals. The trigger pulse triggers circuit part IIIA to generate the first part of the current control signal at its first output terminal. At the end of the first part of the current control signal, the circuit part IIIB is triggered via its fourth input terminal to generate the second part of the current control signal. The output of or-gate OR is only high when the first or the second part of the current control signal is generated. As a consequence the buffer AMP is only enabled during the first and the second time lapse and the signal present at the output of buffer AMP is high during the first time lapse and low during the second time lapse.

The combination of the or-gate OR and the buffer forms an enabling circuit for presenting a three level signal to the output terminal of the module control circuit. This three level signal contains two active states. During the first active state (corresponding to the first part of the current control signal) the output is high and during the second active state (corresponding to the second part of the current control signal) the output is low. During the passive state neither the first nor the second part of the current control signal is generated and the output of the module control circuit is set to high impedance. This results in clearly identifiable changes in the voltage present at the input terminal of the driver control circuit during the active states of the enabling circuits comprised in the module control circuits, also when two or more LED modules are connected to the power supply circuit. Using this embodiment of an enabling circuit results in a relatively simple and effective embodiment for generating a three level signal. It is noted, however, that other circuitry can also be used. It is further noted that an enabling circuit can be dispensed with in case the current control signal only has two states, as in the embodiment in FIG. 2 and in the embodiment shown in FIG. 5. As described here-above the current control signal generated by the LED modules in the LED lighting system of FIG. 2 is periodical and continuous, so that at any moment in time either the first or the second part of the current control signal is generated. In the embodiment in FIG. 5 the current control signal only comprises the first part, so that at any moment in time either the first part of the current control signal is generated or no signal is generated.

The current control signal generated by a single LED module as the result of a trigger pulse generated by the drive control circuit thus comprises one first part and one second part of the current control signal. In case only one LED module is coupled to the power supply circuit, this current control signal is communicated to the input terminal K7 of driver control circuit II via capacitor C1, resistor R3 and terminal K9, and the desired LED current and the temperature of the LEDs is derived from it. The actual LED current is then adjusted accordingly.

Figure 7:
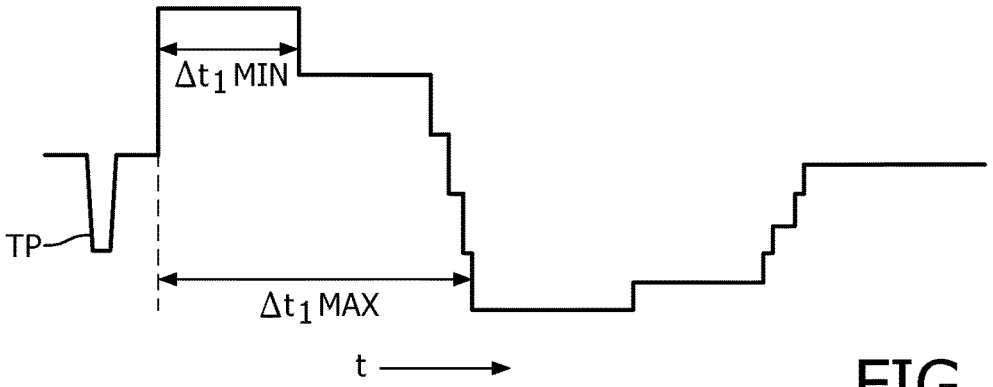
FIG. 7 shows the combined signal of the current control signals generated by LED modules comprised in a LED lighting system as shown in FIG. 3.

In case the LED lighting system comprises more than one LED module, the current control signals generated by the LED modules are communicated to terminal K7 of the driver control circuit by AC coupling and are superimposed to form a combined signal that is present at terminal K7. Since the generation of the current control signals is triggered by the same trigger pulse, the current control signals generated by the LED modules are all synchronized, so that the first part of each current control signal starts at the same moment in time. The resulting combined signal is shown in FIG. 7. In the first part of this combined signal, the smallest time period or lapse $\Delta t1_{MIN}$ corresponds to the smallest desired LED current and the biggest time period or lapse $\Delta t1_{MAX}$ corresponds to the highest desired current. All the desired LED currents can be derived from the time lapses comprised in the first part of the sum signal. It is noted that, even in case the LED modules are all designed for the same desired current, the spread in actual resistance of the resistors R1 comprised in the module control circuits will cause small differences in the durations of the first time lapses of the current control signals generated by different LED modules. This can be seen in the centre of FIG. 7, where there are multiple steps between $\Delta t1_{MIN}$ and $\Delta t1_{MAX}$, when $\Delta t1_{MIN}$ is the shortest first time lapse and $\Delta t1_{MAX}$ is the longest first time lapse in the combined signal.

Furthermore, it is observed that each step between the first and second part of the combined signal is equal to the sum of the first and the second amplitude since the second part of each current control signal is generated immediately after the first part. It can also be seen that the desired current of one of the LED modules is considerably smaller than that of all the others. This could be caused by an error or failure and the driver control circuit can for example be equipped with communication means to report this failure to a user or a building control system that the LED lighting system is part of.

Since the precise durations of the first parts of the current control signals are not identical, it is not possible to determine the durations of the second parts of the current control signal exactly. In other words the temperatures of the LED modules cannot be exactly evaluated because it is clear when the different second time lapses end, but it is not clear when a specific second time lapse has started. This uncertainty can be dealt with by making the second time lapses sufficiently long such that the influence of the starting time becomes negligible. A longer second time lapse results in a smaller influence of the exact starting time on the determined temperatures of the LED modules.

The data comprised in the combined signal regarding desired LED currents and temperature of the LEDs are used in the same way as in the embodiment shown in FIG. 2 to control the current through the LEDs in dependency of whether the LED modules are arranged in parallel or in series.

It is noted that the trigger pulses may be repeated periodically, so that for example the temperature can be monitored. It is also noted that the LED lighting system must be designed in such a way that signals generated by the modules cannot result in triggering of the modules. This can be done by ensuring that the amplitude of the signals is always smaller than the amplitude required for a trigger pulse.

Figure 4:
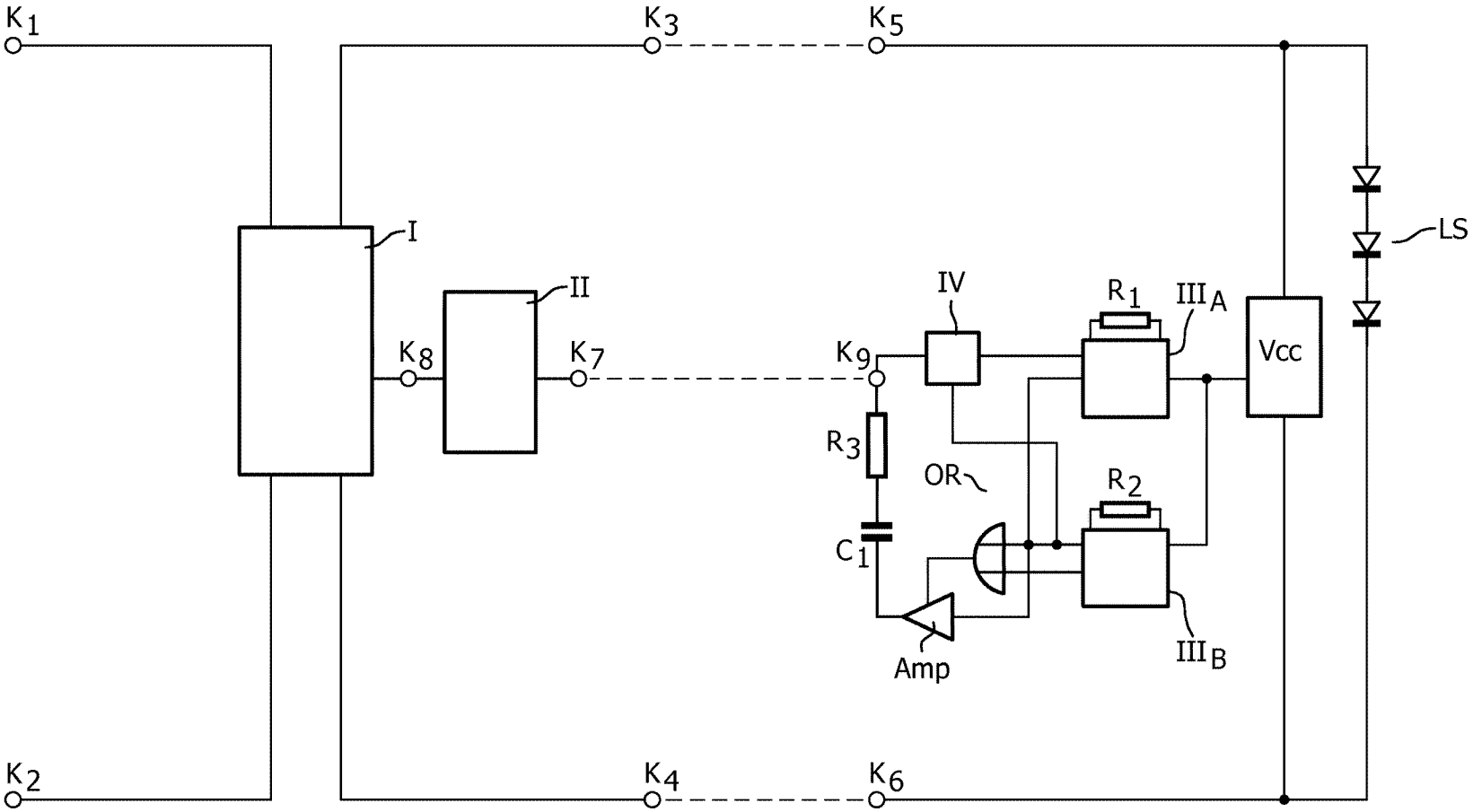

In the embodiment shown in FIG. 4 the circuit part IIIB is not triggered to generate the second part of the current control signal by means of the first part of the current control signal but by an external trigger signal generated by the driver control circuit. Therefore the differences in circuitry between the embodiments shown in FIG. 4 and FIG. 3 are as follows. In FIG. 4 the first output terminal of circuit part IIIA is not connected to the fourth input terminal of circuit part IIIB. Instead the LED module comprises a circuit part IV. Circuit part IV is a circuit part for distributing the trigger signals generated by the driver control circuit II to circuit part IIIA to generate the first part of the current control signal and to circuit part IIIB to generate the second part of the current control signal. Circuit part IV is activated by a trigger pulse generated by the driver circuit. An input terminal of circuit part IV is thereto connected to terminal K9 and a first output terminal is connected to the fourth input terminal of circuit part IIIA. A second output terminal of circuit part IV is coupled to a fourth input terminal of circuit part IIIB.

The operation of the embodiment shown in FIG. 4 is as follows.

In case input terminals K1 and K2 are connected to a power supply source, the driver circuit generates a LED current that flows through the LED load LS. The driver control circuit generates a trigger pulse that is communicated to the input terminal of circuit part IV. Circuit part IV generates a trigger pulse at its first output terminal that triggers circuit part IIIA to generate the first part of the current control signal. After a delay time the driver control circuit again generates a trigger pulse that is communicated to the circuit part IV. Circuit part IV generates a trigger pulse at its second output terminal and triggers circuit part IIIB to generate the second part of the current control signal. The delay time is chosen such that it is longer than the longest possible first time lapse. The first and second part of the current control signal are communicated to the input terminal K7 of driver control circuit II and the desired LED current and the temperature of the LEDs is derived from it. The actual LED current is then adjusted accordingly.

Figure 8:
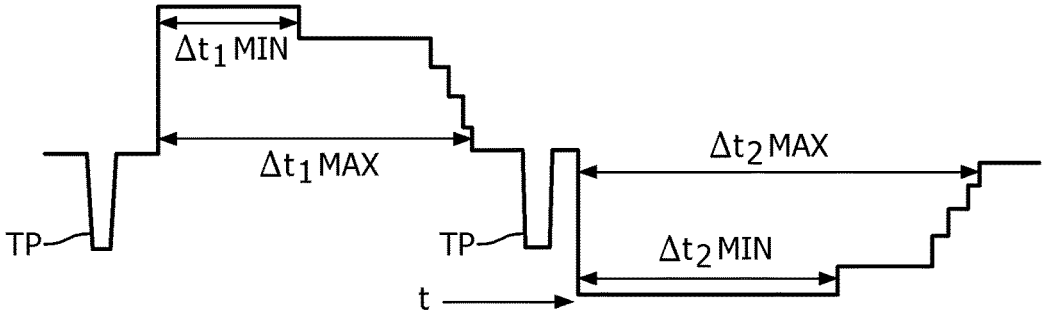
FIG. 8 shows the combined signal of current control signals generated by LED modules comprised in the LED lighting system shown in FIG. 4.

In case the LED lighting system comprises more than one LED module, the current control signals generated by the LED modules are superimposed and the resulting combined signal is communicated to terminal K7 of the driver control circuit. Since the generation of both parts of the current control signals is triggered by a trigger pulse, both parts of the current control signals generated by the LED modules are synchronized, so that the first parts of all of the current control signals start at the same moment in time and the second parts of all of the current control signals also start at the same moment in time. The resulting combined signal is shown in FIG. 8.

Also in this embodiment, the values of the desired LED currents of the different LED modules can be derived from the different durations or sizes of the time lapses comprised in the combined signal of the current control signals. Since the second parts of the current control signal also start at the same moment in time, the values of the temperature of the LEDs in the different LED modules can be derived from the different durations of the time lapses comprised in the combined signal of the current control signals.

It is noted that instead of the generation of a second trigger pulse by the driver control circuit, it is also possible for example to include a timer in each of the LED modules that after the delay time activates the current control module to generate the second part of the current control signal.

Figure 5:
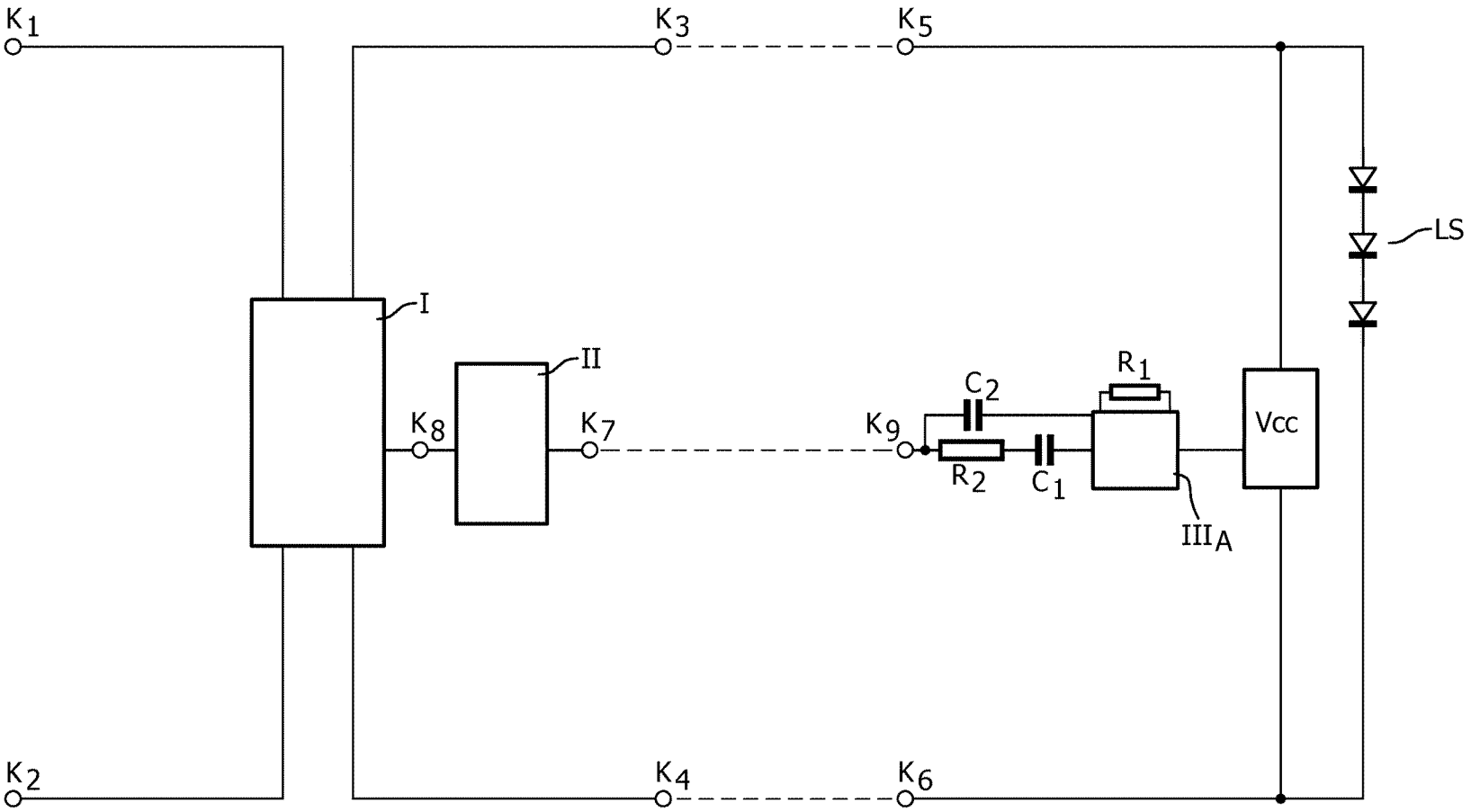

The embodiment shown in FIG. 5 differs from the one shown in FIG. 3, in that there is no circuit part IIIB. Furthermore regular resistor R3 has been replaced by temperature dependent resistor R2. More in particular R2 is a temperature dependent NTC-type resistor. Also or-gate "OR" and buffer AMP forming the enabling circuit are dispensed with.

The operation of the embodiment shown in FIG. 5 is as follows.

In case input terminals K1 and K2 are connected to a power supply source, the driver circuit generates a LED current that flows through the LED load LS. The driver control circuit generates a trigger pulse that is communicated to the coupling terminal K9 and triggers circuit part IIIA to generate the first part of the current control signal. This current control signal is communicated to input terminal K7 of the driver control circuit. Since the resistor R2 is of the type NTC, the resistance of resistor R2 becomes lower when the temperature of the LED module becomes higher. More in particular it is desirable to place resistor R2 in such a part of the LED module that it reflects the temperature of the LEDs. In case the temperature of the LEDs is higher, the resistance of resistor R2 is lower, so that the amplitude of the first part of the current control signal is higher. This amplitude can be measured and the corresponding temperature can be derived from it by the driver control circuit. To this end the driver control circuit may be equipped with a microprocessor and a memory comprising a table relating amplitude values and number of LED modules to temperature values (as explained here-above the amplitude of a current control signal in the combined signal depends on the number of LED modules connected to the power supply circuit). In case the temperature is too high, for example higher than a defined maximum temperature value, the driver control circuit may decrease the LED current.

Figure 9:
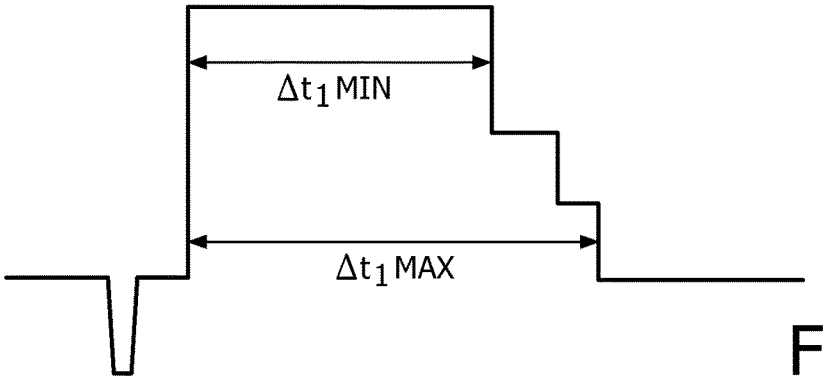
FIG. 9 shows the combined signal of current control signals generated by LED modules comprised in the LED lighting system shown in FIG. 5.

In case the LED lighting system comprises more than one LED module, the current control signals generated by the LED modules are added and the combined signal is communicated to terminal K7 of the driver control circuit. Since the generation of the current control signals (only comprising first parts in this embodiment) is triggered by a trigger pulse, the current control signals generated by the LED modules are synchronized, so that all of the current control signals start at the same moment in time. The resulting combined signal is shown in FIG. 9 for an example of three LED modules. By measuring the amplitudes of the current control signals comprised in the combined signal, the driver control circuit can determine the temperatures of the LEDs in each of the different LED modules when the number of connected LED modules is known. From FIG. 9 it can be seen that the LED module with the smallest time lapse size, and therefore lowest desired LED current, also has the highest amplitude and thus the highest temperature.

While the invention has been illustrated and described in detail in the drawings and foregoing description, such illustration and description are to be considered illustrative or exemplary and not restrictive; the invention is not limited to the disclosed embodiments. Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. A light emitting diode (LED) lighting system, comprising:

a power supply circuit comprising:

power input terminals, for connection to a power supply source, output terminals, and a driver circuit coupled between the power input terminals and the output terminals for generating a LED current, and the driver circuit comprising a driver control circuit with a current control input terminal, at least one LED module, each of the at least one LED module comprising:

LED module input terminals connected to the output terminals of the power supply circuit, an LED load coupled between the LED module input terminals, a voltage supply circuit having input terminals connected between the LED module input terminals, and having an output terminal; and a module control circuit having an input terminal connected to the output terminal of the voltage supply circuit, the module control circuit being configured to generate a current control signal, wherein the current control signal includes a first part having a first amplitude during a first time interval, a duration of the first time interval representing a desired magnitude of the LED current, said module control circuit including a series capacitor for capacitively coupling the current control signal to the current control input terminal of the driver control circuit, wherein the current control signal of the at least one LED module is coupled to the control input terminal of the driver control circuit, and wherein the driver control circuit is configured to generate the LED current having a magnitude which is dependent on the duration of the first time interval of the current control signal.

2. The LED lighting system of claim 1, wherein the current control signal is temperature dependent.

3. The LED lighting system of claim 2, wherein the at least one LED module includes a coupling terminal connected to the current control input terminal of the driver control circuit for coupling the current control signal to the current control input terminal of the driver control circuit, and wherein the module control circuit comprises a temperature dependent impedance in series with the coupling terminal and wherein the driver control circuit comprises circuitry for adjusting the LED current in dependency of an amplitude of the current control signals received at the current control input terminal of the driver control circuit.

4. The LED lighting system of claim 2, wherein the current control signal further includes a second part that has a second amplitude during a second time interval, wherein a duration of the second time interval represents temperatures of LEDs in the at least one LED module.

5. The LED lighting system of claim 4, wherein the current control signal is a periodical signal, wherein each period includes the first part of the current control signal and the second part of the current control signal.

6. The LED lighting system of claim 4 wherein the module control circuit comprises a first resistor with a resistance representing the desired magnitude of the LED current, and wherein the module control circuit comprises a timer circuit coupled to the first resistors for generating the first part of the current control signal, wherein the duration of the first time interval is a function of the resistance of the first resistor, and wherein the module control circuit comprises a second resistor with a temperature dependent resistance, wherein the second resistor is coupled to the timer circuit and the timer circuit is configured to generate the second part of the current control signal, wherein the duration of the second time interval is a function of the resistance of the second resistor.

7. The LED lighting system of claim 5, comprising at least two LED modules, wherein the driver control circuit is equipped with circuitry for deriving the periodical current control signals generated by each of the LED modules, from a combined signal formed by superimposed AC coupled periodical current control signals generated by the LED modules.

8. The LED lighting system of claim 7, wherein the driver control circuit comprises circuitry for determining a total LED current supplied to the LED modules in dependency of a sum of the desired magnitudes of the LED current represented by the durations of the first time intervals of a first current control signals, in case the LED modules are arranged in parallel.

9. The LED lighting system of claim 7, wherein the driver control circuit comprises circuitry for determining a total LED current supplied to the LED modules in dependency of a smallest desired magnitude of the LED current represented by the duration of the first time interval in a first current control signal, in case the LED modules are arranged in series.

10. The LED lighting system of claim 8, wherein the driver control circuit comprises circuitry for decreasing the total LED current in case one or more of second parts of the current control signals indicate that temperature of said at least one LED module is too high.

11. The LED lighting system of claim 1, wherein the module control circuit comprises a first resistor with a resistance representing the desired magnitude of the LED current, and wherein the module control circuit comprises a timer circuit coupled to the first resistor for generating the first part of the current control signal, and wherein the duration of the first time interval is a function of the resistance of the first resistor.

12. The LED lighting system of claim 1, comprising at least two LED modules, wherein the driver control circuit is equipped with circuitry for deriving the desired magnitudes of the LED current of the LED modules from a combined signal formed by superimposed AC coupled periodical current control signals generated by the LED modules.

13. The LED lighting system of claim 12, wherein the module control circuits comprise circuitry for generating a second part immediately after the first part of the current control signal, and wherein the driver control circuit comprises circuitry for determining temperatures of LEDs in the LED modules from the combined signal.

14. The LED lighting system of claim 12, wherein the LED lighting system comprises circuitry for activating the module control circuits of the LED modules to generate second parts of the current control signals after a delay with respect to a start of first parts of the current control signals, the delay being longer than a longest possible first part of the current control signal, and wherein the driver control circuit comprises circuitry for deriving temperatures of LEDs in the LED modules from a second time intervals in a combined signal.

15. A method for operating at least one light emitting diode (LED) module comprising an LED load by means of a driver circuit comprised in a power supply circuit, the method comprising:

generating a current control signal for the at least one LED module, wherein the current control signal includes a first part having a first amplitude during a first time interval, a duration of the first time interval representing a desired magnitude of the LED current of the at least one LED module, capacitively coupling the current control signal to an input terminal of a driver control circuit via a series capacitor of a coupling circuit, generating an LED current using the driver control circuit, a magnitude of the LED current being based at least in part on the duration of the first time interval of the current control signal, and supplying the LED current to the LED load.

16. The method of claim 15, wherein the current control signal is temperature dependent.

17. The method of claim 15, wherein the current control signal further includes a second part that has a second amplitude during a second time interval, the duration of the second time interval representing temperature of the LEDs in the at least one LED module.

18. The method of claim 15, further comprising:

communicating the current control signal from a coupling terminal of the at least one LED module to the input terminal of the driver control circuit via the capacitive coupling, wherein the driver control circuit includes an output terminal which is coupled to an input terminal of a circuit which supplies the LED current to the LED load; and receiving at the coupling terminal of each LED module a triggering pulse from the input terminal of the driver control circuit, wherein the at least one LED module generates the current control signal in response to the triggering pulse.

19. A light emitting diode (LED) module, comprising:

LED module input terminals configured to be coupled to output terminals of a power supply circuit and to receive an LED current;

an LED load coupled between the LED module input terminals and being configured to receive the LED current and to emit light having an intensity in correspondence to a magnitude of the LED current;

a module control circuit configured to generate a current control signal having a first part with a first amplitude during a first time interval, duration of the first time interval representing a desired magnitude of the LED current, wherein the module control circuit includes a coupling circuit including a series capacitor configured to capacitively couple the current control signal out of the LED module to a current control input terminal of a driver control circuit of the power supply circuit.

20. The LED module of claim 19, wherein the module control circuit includes:

a first resistor having a resistance value which represents the desired magnitude of the LED current; and a timer circuit configured to generate the current control signal, wherein the timer circuit controls the duration of the first time interval dependent on the resistance value of the first resistor.

* * * * *